US006172450B1

(12) United States Patent
Natori et al.

(10) Patent No.: US 6,172,450 B1
(45) Date of Patent: Jan. 9, 2001

(54) ELECTION GUN HAVING SPECIFIC FOCUSING STRUCTURE

(75) Inventors: Makoto Natori, Kanagawa; Yasunobu Amano, Tokyo, both of (JP)

(73) Assignee: Sony Corporation, Tokyo (JP)

( * ) Notice: Under 35 U.S.C. 154(b), the term of this patent shall be extended for 0 days.

(21) Appl. No.: 09/135,405

(22) Filed: Aug. 18, 1998

(30) Foreign Application Priority Data

Aug. 25, 1997 (JP) ..... 9-228268

(51) Int. Cl.[7] ..... H01J 29/50
(52) U.S. Cl. ..... 313/414; 313/412; 313/426
(58) Field of Search ..... 313/414, 412, 313/426

(56) References Cited

U.S. PATENT DOCUMENTS

| | | |
|---|---|---|
| 4,736,133 | 4/1988 | Barbin et al. . |
| 4,814,670 | 3/1989 | Suzuki et al. . |
| 4,886,999 | 12/1989 | Yamane et al. . |
| 5,061,881 | 10/1991 | Suzuki et al. . |

FOREIGN PATENT DOCUMENTS

| | | |
|---|---|---|
| 37 41 202 | 6/1988 | (DE) . |
| 41 42 979 | 7/1992 | (DE) . |
| 2 314 966 | 1/1998 | (GB) . |

*Primary Examiner*—Vip Patel
(74) *Attorney, Agent, or Firm*—Ronald P. Kananen; Rader, Fishman & Grauer

(57) ABSTRACT

In an inline 3-beam system color cathode-ray tube, an inline 3-beam system color cathode-ray tube electron gun is able to uniformise shapes of beam spots of three electron beams on the right and left end portion of a fluorescent screen as much as possible. In an electron gun (10) in which focusing electrodes (51), (52) are divided by four to provide at least a first focusing electrode (51A), a second focusing electrode (51B), a third focusing electrode (51C), a fourth focusing electrode (52) and a quadrupole lens action formed by the third focusing electrode (51C) and the fourth focusing electrode (52) is controlled by a quadrupole lens formed by the first focusing electrode (51A), the second focusing electrode (51B) and the third focusing electrode (51C), in the first focusing electrode (51A), the second focusing electrode (51B) and the third focusing electrode (51C), openings corresponding to right and left electron beams R, B have different aspect ratios in adjacent focusing electrodes of the first focusing electrode (51A), the second focusing electrode (51B) and the third focusing electrode (51C), and the aspect ratio of the openings is set in such a manner that a major diameter/minor diameter is greater than 1.05.

7 Claims, 17 Drawing Sheets

ELECTION GUN HAVING SPECIFIC FOCUSING STRUCTURE

BACKGROUND OF THE INVENTION

The present invention relates to an inline 3-beam color cathode-ray tube electron gun for use as a color image receiving tube or a color cathode-ray tube comprising a color display device and so on.

At present, there is an increasing demand of improving a resolution of a color cathode-ray tube. In particular, a problem concerning a shape of an electron beam spot at the periphery of a picture screen receives a remarkable attention.

In general, a resolution characteristic of a color cathode-ray tube considerably depends upon the size and shape of an electron beam on the fluorescent screen serving as a screen. That is, if the diameter of this electron beam spot were not small and were not close to a real circle, a satisfactory resolution characteristic could not be obtained.

As a deflection angle of an electron beam increases, an electron beam passage ranging from a cathode-ray tube electron gun to a fluorescent screen is extended. Therefore, if a focusing voltage is maintained in order to obtain an electron beam spot of a small diameter and of a real circle at the central portion of the fluorescent screen, the electron beam at the peripheral portion of the fluorescent screen is placed in the so-called over-focusing state. As a consequence, an electron beam spot of a small diameter and of a real circle cannot be obtained at the peripheral portion of the fluorescent screen so that a satisfactory resolution cannot be obtained.

To solve the above-mentioned problem, there is recently proposed a dynamic focusing system cathode-ray tube electron gun in which a main lens action is weakened by increasing a focusing voltage relative to electron beams bombarded on the peripheral portion of the fluorescent screen as the deflection angle of the electron beam increases.

This dynamic focusing system, however, is not so suitable for the inline 3-beam system cathode-ray tube electron gun without modification. That is, in the prior-art inline 3-beam system cathode-ray tube electron gun in which three cathodes are aligned on one linear line in the horizontal direction, when deflection magnetic fields of a deflection yoke are equal, a vertically-arcuate convergence error (i.e. over-convergence) occurs in the upper, lower, right and left peripheral portions of the fluorescent screen.

Accordingly, a dynamic convergence is executed under the condition that a horizontal deflection magnetic field distribution obtained by the deflection yoke is presented as a pin-cushion-like distribution and that a vertical deflection magnetic field distribution is presented as a barrel-like distribution.

However, when the deflection yoke thus arranged is in use, electron beams deflected toward the peripheral portions of the fluorescent screen after they had passed the deflection yoke are subjected to a convergence action (convex lens effect) in the vertical direction (longitudinal direction) thereof and also subjected to a divergence action (concave lens effect) in the horizontal direction (lateral direction) thereof.

As a result, an electron beam spot at the peripheral portions of the fluorescent screen does not become a real circle but becomes oblong. There is then the problem that the electron beam spot is distorted in the left and right peripheral portions of the fluorescent screen and that the focusing characteristic is deteriorated.

In order to solve the aforementioned problems, Japanese laid-open patent publications Nos. 61-99249, 62-237642 or Japanese laid-open patent publication No. 3-93135, etc. proposed cathode-ray tube electron guns having a so-called electrostatic quadruple lens (hereinafter simply referred to as "quadruple lens") incorporated therein.

FIG. 1 is a schematic diagram showing an arrangement of a color cathode-ray tube electron gun incorporating a quadruple lens used widely.

As shown in FIG. 1, an electron gun 70 includes three cathodes KR, KG, KB parallelly arrayed in an inline fashion. A first electrode 11, a second electrode 12, a third electrode 13, a fourth electrode 14, a fifth electrode, a sixth electrode 16 and a shield cup 17 are coaxially disposed from this cathode K (KR, KG, KB) to the anode side, in that order. Then, the fifth electrode is halved to provide a 5-1th electrode 51 and a 5-2th electrode 52. The second electrode 12 and the fourth electrode 14 are connected with each other electrically.

In this color cathode-ray tube electron gun 70, a constant focusing voltage $V_F$ is applied to the 5-1th electrode 51. On the other hand, a voltage ($V_F$+$V_{DF}$) in which a parabolic waveform dynamic focusing voltage VDF (see FIG. 4) synchronized with the horizontal deflection of the focusing voltage $V_F$ and the focusing voltage VF are superimposed upon each other is applied to the third electrode 14 and the 5-2th electrode 52.

Thus, a quadruple lens (not shown) is formed between the 5-1th electrode 51 and the 5-2th electrode 52, and this quadruple lens causes an intensity change of a focusing lens formed between the 5-2th electrode 52 and the sixth electrode 16. As a result, it is possible to obtain satisfactory shapes of electron beams on the left and right peripheral portions of the fluorescent screen.

On the surface of the 5-1th electrode 51 opposing the 5-2th electrode 52 is disposed a plate 151 in which there are defined vertically-oblong electron beam passing apertures 151A, 151B, 151C shown in FIG. 3A. On the other hand, on the surface of the 5-2th electrode 52 opposing the 5-1th electrode 51 is disposed a plate 152 in which there are defined horizontally-oblong electron beam passing apertures 152A, 152B, 152C shown in FIG. 3B.

FIG. 2 is a schematic diagram showing an arrangement of a color cathode-ray tube electron gun incorporating a quadruple lens used widely.

While the fifth electrode is halved to provide the 5-1th electrode 51 and the 5-2th electrode 52 in the electron gun 70 shown in FIG. 1, in an electron gun 80 shown in FIG. 2, the fifth electrode 5 is divided by three to provide the 5-1th electrode 51, the 5-2th electrode 52 and a 5-3th electrode 53 as shown in FIG. 2. A rest of the arrangement of the electron gun 80 is similar to that of the electron gun 70 shown in FIG. 1. Therefore, in FIG. 2, elements and parts identical to those of FIG. 1 are marked with the same reference numerals and need not be described in detail.

In this color cathode-ray tube electron gun 80, as shown in FIG. 2, the constant focusing voltage VF is applied through a stem portion to the central 5-2th electrode 52 of the fifth electrode thus divided by three. On the other hand, the voltage ($V_F$+$V_{DF}$) in which the dynamic focusing voltage VDF (see FIG. 4) synchronized with the horizontal deflection of the focusing voltage VF and the focusing voltage VF are superimposed upon each other is applied to the third electrode 13 and the 5-1th electrode 51 and the 5-3th electrode 53 located in the outside of the fifth electrode thus divided by three.

Thus, two quadruple lenses (not shown) which are adapted to act in the opposite directions, respectively, are formed between the 5-1th electrode 51 and the 5-2th electrode 52 and between the 5-2th electrode 52 and the 5-3th electrode 53. The two quadruple lenses causes an intensity change of a focusing lens (not shown) formed between the 5-3th electrode 53 and the sixth electrode 16. As a result, shapes of electron beams in the left and right peripheral portions of the fluorescent screen may become more satisfactory, i.e. may become substantially close to the shape of the electron beam in the central portion of the fluorescent screen.

On the surface of the 5-1th electrode 51 opposing the 5-2th electrode 52 and the surface of the 5-2th electrode 52 opposing the 5-3th electrode 53 is disposed the plate 151 on which there are defined the vertically-oblong electron beam passing apertures 151A, 151B, 151C as shown in FIG. 3A.

On the other hand, on the surface of the 5-2th electrode opposing the 5-1th electrode and the surface of the 5-3th electrode 53 opposing the 5-2th electrode 52 is disposed the plate 152 in which there are defined the horizontally-oblong electron beam passing apertures 152A, 152B, 152C as shown in FIG. 3B.

Since the quadruple lenses are provided as described above, as the electron beams approach the end portions of the fluorescent screen in the horizontal direction, the electron beam is subjected to a divergence action (concave lens effect) in the vertical direction (longitudinal direction) thereof, and also subjected to a convergence action (convex lens effect) in the horizontal direction (lateral direction) thereof. As a consequence, electron beam spots on the peripheral portions of the fluorescent screen become almost real circles, thereby resulting in a satisfactory resolution being obtained.

The effects achieved by the quadruple lenses are remarkable as described above.

The method of operating the quadruple lens and the dynamic focusing voltage simultaneously is widely available in electron guns for use in color-cathode ray tubes of a display, a jumbo-size TV and a high-definition TV.

In the above-mentioned prior-art technologies, the three electron beams R, G, B receive the quadruple lens effect of the same amount.

Accordingly, as shown in FIG. 5, three electron beams R, G, B emitted from an electron gun 1 and which impinge upon the peripheral portions of the right-hand side screen and the left-hand side screen of a fluorescent screen 4 are converged and diverged in the magnetic field of a deflection yoke 2 by different amounts, respectively, so that distortion states of electron beams on the right and left peripheral portions of the fluorescent screen 4 become different in the three electron beams R, G, B. In FIG. 5, reference numeral 3 denotes a glass bulb. Also, "right-hand side screen" and "left-hand side screen" refer to the right-hand side and the left-hand side presented when a viewer watches the fluorescent screen 4 of the color cathode-ray tube from the outside.

The focusing voltage VF or the like is generally set in such a manner as to optimize the shape of the beam spot of the central electron beam G of the three electron beams R, G, B.

In this case, when the three electron beams R, G, B impinge upon the right-hand side of the fluorescent screen 4, the electron beam R is more strongly affected by the deflection magnetic field formed by the deflection yoke 2 as compared with the electron beams G and B. As a consequence, the distortion of the beam spot of the electron beam R on the fluorescent screen 4 becomes larger than those of the remaining electron beams G, B.

On the other hand, when the three electron beams R, G, B impinge upon the left-hand side of the fluorescent screen 4, the electron beam B is more strongly affected by the deflection magnetic field formed by the deflection yoke 2 as compared with the electron beams G and R. As a result, the distortion of the beam spot of the electron beam B on the fluorescent screen 4 becomes larger than those of the remaining electron beams R, G.

FIGS. 6A and 6B are schematic diagrams showing the manner in which beam spots of electron beams are formed on the fluorescent screen 4, respectively.

FIG. 6A shows the state of the beam spot obtained by the color cathode-ray tube electron gun of the structure having one quadruple lens shown in FIG. 1.

On the other hand, FIG. 6B shows the state of the beam spot obtained by the color cathode-ray tube electron gun of the structure having two quadruple lenses shown in FIG. 6B.

The state (FIG. 6B) of the beam spots of the electron beams obtained in the color cathode-ray tube electron gun of the structure having the two quadruple lenses may provide beam spots of almost real circles and become satisfactory as compared with the state (FIG. 6A) of the beam spots of the electron beams obtained in the color cathode-ray tube electron gum of the structure having one quadruple lens.

However, in FIGS. 6A and 6B, the shapes of the beam spots of the two outside electron beams R, B are different from the shape of the beam spot of the central electron beam G, and deteriorated as compared with the shape of the beam spot of the central electron beam G which is in the so-called just-focus state (i.e. properly focused state).

The innermost beam spot of the three beam spots corresponding to the respective electron beams, i.e. the beam spot of the electron beam R on the right-hand side of the screen and the beam spot of the electron beam B on the left-hand side of the screen are, in particular, deteriorated considerably. In these beam spots, there is presented the over-focused state, and a so-called halation occurs.

In a recent jumbo-size color display monitor having a high resolution, it is frequently observed that red characters on the right-hand side of the fluorescent screen 4 are caused to become unclear by such phenomenon and that blue characters on the left-hand side of the fluorescent screen 4 are caused to become unclear by such phenomenon.

As one means for solving the aforesaid problem, there is known a method of reducing a diameter of a beam spot of an electron beam at the center of the magnetic field by the deflection yoke 2.

Specifically, by reducing the diameter of the beam spot of the electron beam at the center of the magnetic field by the deflection yoke 2, it is possible to reduce the influence exerted upon the electron beams by the magnetic field generated from the deflection yoke 2 depending upon the position at which the electron beams pass the deflection yoke 2 as much as possible.

The above-mentioned means for reducing the diameter of the beam spot of the electron beam, however, encounters with the following problems.

1. Effects achieved thereby are not sufficient:
2. Since the diameter of the beam spot of the electron beam at the center of the magnetic field from the deflection yoke is reduced, the size of the beam spot of the electron beam at the center of the screen is increased.

In a 20-inch color display monitor which is now commercially available on the market, a difference between the focusing voltage VF required when the electron beams R, G, B shown in FIG. 6A are obtained and the focusing voltage VF required when the state of the beam spot of the electron beam R on the right-hand side of the fluorescent screen 4 becomes the state of the beam spit of the electron beam G shown in FIG. 6A amounts to about 100 V.

Naturally, if the state of the beam spot of the electron beam R on the right-hand side end portion of the fluorescent screen 4 is made close to the state of the beam spot of the electron beam G shown in FIG. 6A, then the shape of the beam spot of the electron beam G is deteriorated. Accordingly, the means for reducing the diameter of the beam spot of the electron beam at the center of the magnetic field from the deflection yoke 2 is not effective as the means for solving the aforementioned problem.

SUMMARY OF THE INVENTION

In view of the aforesaid aspect, it is an object of the present invention to provide an inline 3-beam system color cathode-ray tube electron gun in which shapes of beam spots of three electron beams on the right and left end portions of a fluorescent screen may be uniformized as much as possible.

According to an aspect of the present invention, in an electron gun in which a focusing electrode is divided by four to provide at least a first focusing electrode, a second focusing electrode, a third focusing electrode and a fourth focusing electrode and a quadruple lens action formed by the third focusing electrode and the fourth focusing electrode is controlled by a quadruple lens formed by the first focusing electrode, the second focusing electrode and the third focusing electrode, a color cathode-ray tube electron gun is characterized in that, in the first focusing electrode, the second focusing electrode and the third focusing electrode, openings corresponding to right and left electron beams have different aspect ratios in adjacent focusing electrodes of the first focusing electrode, the second focusing electrode and the third focusing electrode and that the opening aspect ratio is set in such a manner that a major diameter/minor diameter is greater than 1.05.

According to another aspect of the present invention, in an electron gun in which a focusing electrode is divided by four to provide at least a first focusing electrode, a second focusing electrode, a third focusing electrode and a fourth focusing electrode and a quadruple lens action formed by the third focusing electrode and the fourth focusing electrode is controlled by a quadruple lens formed by the first focusing electrode, the second focusing electrode and the third focusing electrode, a color cathode-ray tube electron gun is characterized in that thicknesses of the first focusing electrode and the third focusing electrode are greater than that of the second focusing electrode.

According to the arrangement of the present invention, since the adjacent focusing electrodes have different aspect ratios and the aspect ratio of the opening is set in such a manner that a major diameter/minor diameter is selected to be greater than 1.05, an influence exerted upon the central electron beam from the right and left electron beams of three electron beams may be decreased.

Further, according to other arrangement of the present invention, since the thicknesses of the first focusing electrode and the third focusing electrode are greater than that of the second focusing electrode, the same potential portions of the first focusing electrode and the third focusing electrode may be extended, thereby resulting in a difference between focusing voltages of the right and left electron beams of the three electron beams being canceled out.

According to the present invention, in an electron gun in which a focusing electrode is divided by four to provide at least a first focusing electrode, a second focusing electrode, a third focusing electrode and a fourth focusing electrode and a quadruple lens action formed by the third focusing electrode and the fourth focusing electrode is controlled by a quadruple lens formed by the first focusing electrode, the second focusing electrode and the third focusing electrode, a color cathode-ray tube electron gun is characterized in that, in the first focusing electrode, the second focusing electrode and the third focusing electrode, openings corresponding to right and left electron beams have different aspect ratios in adjacent focusing electrodes of the first focusing electrode, the second focusing electrode and the third focusing electrode and that the opening aspect ratio is set in such a manner that a major diameter/minor diameter is greater than 1.05.

Further, according to the present invention, in a color cathode-ray tube electron gun, the openings corresponding to the right and left electron beams are set in the first focusing electrode, the second focusing electrode and the third focusing electrode in such a manner that openings defined on one end side are set in a relationship of vertically-oblong, horizontally-oblong, vertically-oblong and openings defined on the other end side are set in a relationship of horizontally-oblong, vertically-oblong, vertically-oblong.

Further, according to the present invention, in a color cathode-ray tube electron gun, a space between the focusing electrodes of the first focusing electrode, the second focusing electrode and the third focusing electrode is selected in a range of from 0.3 to 0.7 mm.

Further, according to the present invention, in a color cathode-ray tube electron gun, the openings have protruded portions of overhung shape formed thereon.

According to the present invention, in an electron gun in which a focusing electrode is divided by four to provide at least a first focusing electrode, a second focusing electrode, a third focusing electrode and a fourth focusing electrode and a quadruple lens actin formed by the third focusing electrode and the fourth focusing electrode is controlled by a quadruple lens formed by the first focusing electrode, the second focusing electrode and the third focusing electrode, a color cathode-ray tube electron gun is characterized in that thicknesses of the first focusing electrode and the third focusing electrode are greater than that of the second focusing electrode.

Further, according to the present invention, there is provided a color cathode-ray tube electron gun, wherein openings corresponding to right and left electron beams are set in a relationship of vertically-oblong, horizontally-oblong, vertically-oblong in the first focusing electrode, the second focusing electrode and the third focusing electrode.

Furthermore, according to the present invention, there is provided a color cathode-ray tube electron gun, wherein the openings have protruded portions of overhung shape formed thereon.

DESCRIPTION OF THE PREFERRED EMBODIMENTS

Electron guns according to embodiments of the present invention will hereinafter be described with reference to the drawings.

Figure 7:
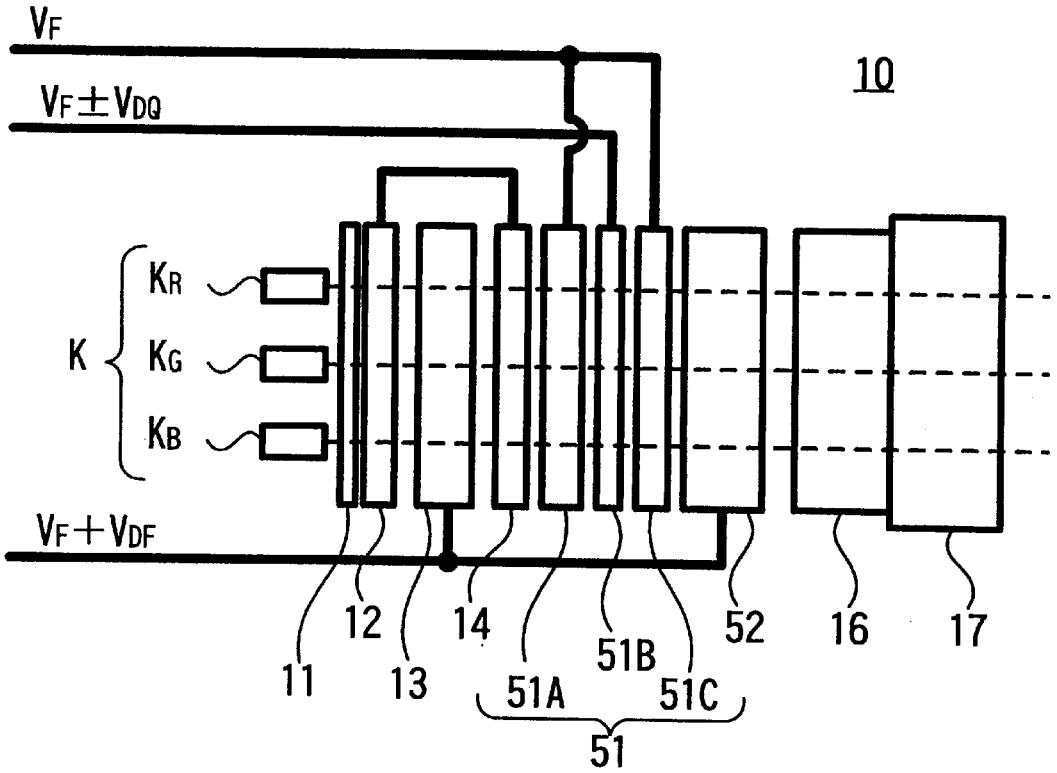
FIG. 7 is a schematic diagram showing the layout of electrodes of an electron gun according to an embodiment of the present invention.

As shown in FIG. 7, an electron gun 10 includes three cathodes KR, KG, KB which are parallelly arrayed in an inline fashion. From the cathodes KR, KG, KB to the anode side, a first electrode 11, a second electrode 12, a third electrode 13, a fourth electrode 14, a fifth electrode, a sixth electrode 16 and a shield cup 17 are disposed coaxially, in that order.

Then, the fifth electrode which corresponds to the focusing electrode is halved to provide a 5-1th electrode 51 and a 5-2th electrode 52. Further, the 5-1th electrode 51 is divided by three to provide a 5-1Ath electrode 51A serving as a first focusing electrode portion, a 5-1Bth electrode 51B serving as a second focusing electrode portion and a 5-1Cth electrode 51C serving as a third focusing electrode portion.

Accordingly, the focusing electrode (fifth electrode) is divided by four, and controls a quadruple lens action formed by the third focusing electrode portion (5-1Cth electrode 51C) and the fourth focusing electrode portion (5-2th electrode 52) by a quadruple lens formed by the first focusing electrode portion (5-1Ath electrode 51A), the second focusing electrode portion (5-1Bth electrode 51B) and the third focusing electrode portion (5-1Cth electrode 51C).

Figure 10:
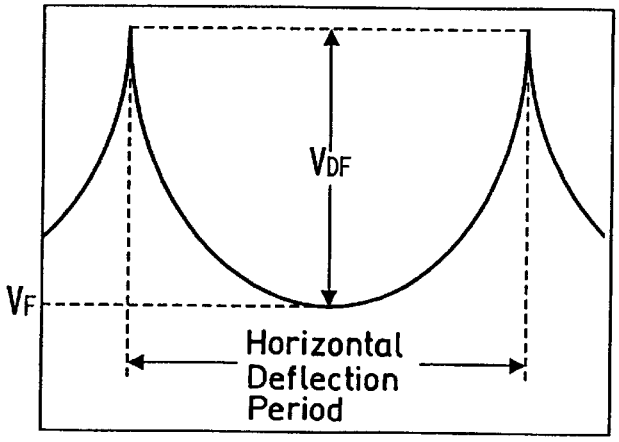
FIG. 10 is a diagram showing an example of a waveform of a dynamic focusing voltage used in the electron gun shown in FIG. 7.

The focusing voltage VF is applied to the first and third focusing electrode portions 51A and 51C, a voltage ($V_F \pm V_{DQ}$) in which the focusing voltage VF and a dynamic quadruple voltage VDQ, which will be described later on, are superimposed upon each other is applied to the second focusing electrode portion 51B, and a voltage ($V_F + V_{DF}$) in which a dynamic focusing voltage VDF (see FIG. 10) synchronized with the horizontal deflection of the focusing voltage $V_F$ and the focusing voltage $V_F$ are superimposed upon each other is applied to the third electrode 13 and the 5-2th electrode 52.

Figure 1:
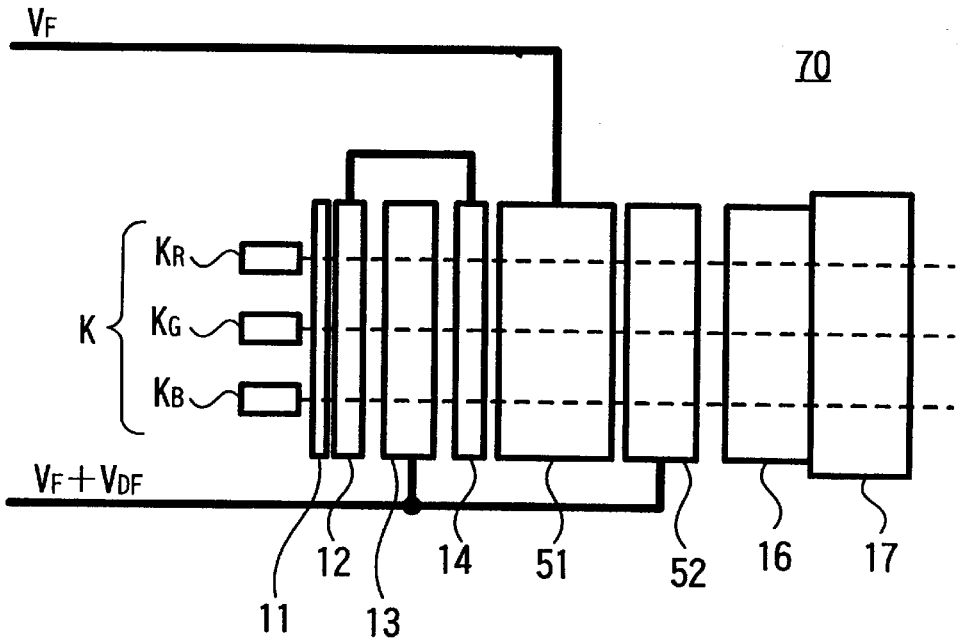
FIG. 1 is a schematic diagram showing an example of a color cathode-ray tube electron gun housing a quadruple lens therein according to the prior art.

In the electron gun according to this embodiment, a rest of the arrangement is similar to that of the prior-art electron gun 70 shown in FIG. 1. Therefore, in FIG. 7, elements and parts identical to those of FIG. 1 are marked with the same references and need not be described in detail.

Figure 8A:
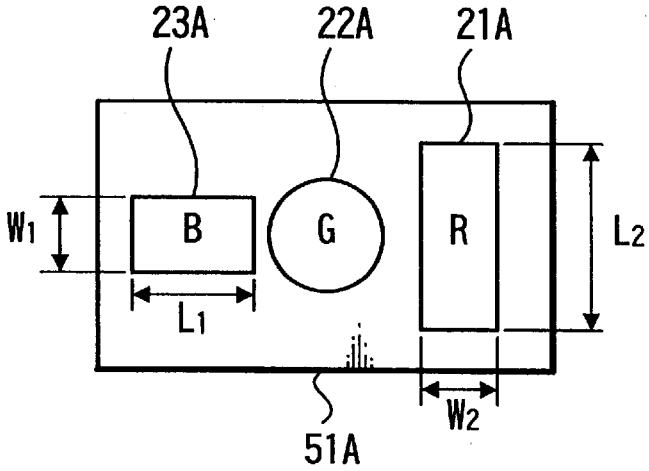
FIGS. 8A, 8B, 8C are schematic diagrams showing an example of a shape of a 5-1th electrode of the electron gun shown in FIG. 7, respectively.
Figure 8B:
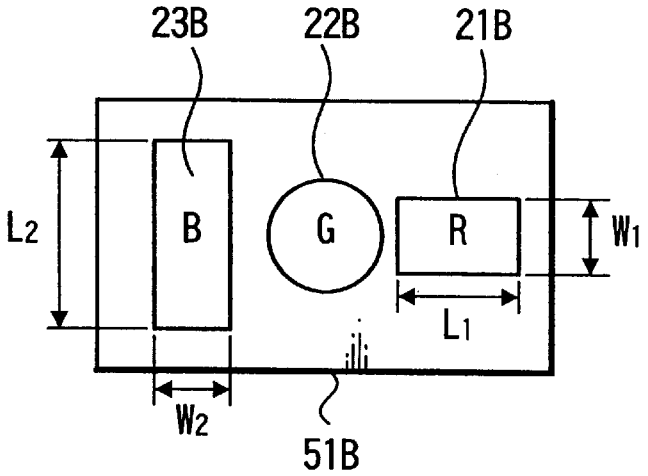
Figure 8C:
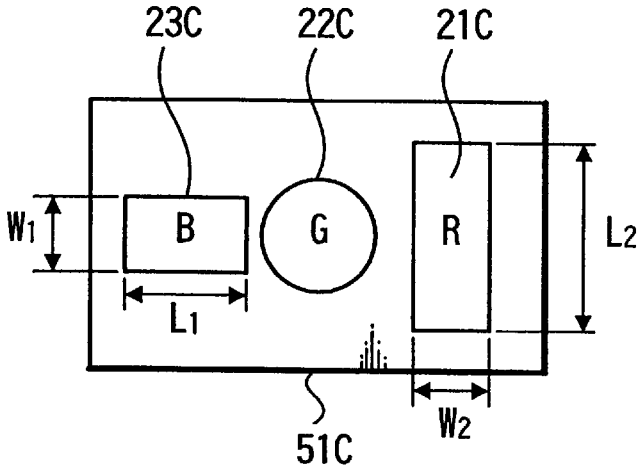

The respective focusing electrode portions, i.e. the 5-1Ath electrode 51A, the 5-1Bth electrode 51B and the 5-1Cth electrode 51C include three electron beam passing apertures. FIGS. 8A, 8B, 8C schematically show examples of shapes of electron beam passing apertures of the respective focusing electrode portions 51A, 51B, 51C, respectively.

Figure 9A:
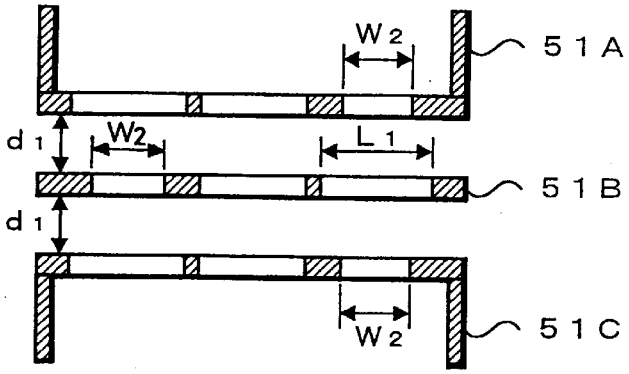
FIGS. 9A and 9B are a cross-sectional view and a perspective view showing a positional relationship of the 5-1th electrode of the electron gun shown in FIG. 7, respectively.
Figure 9B:
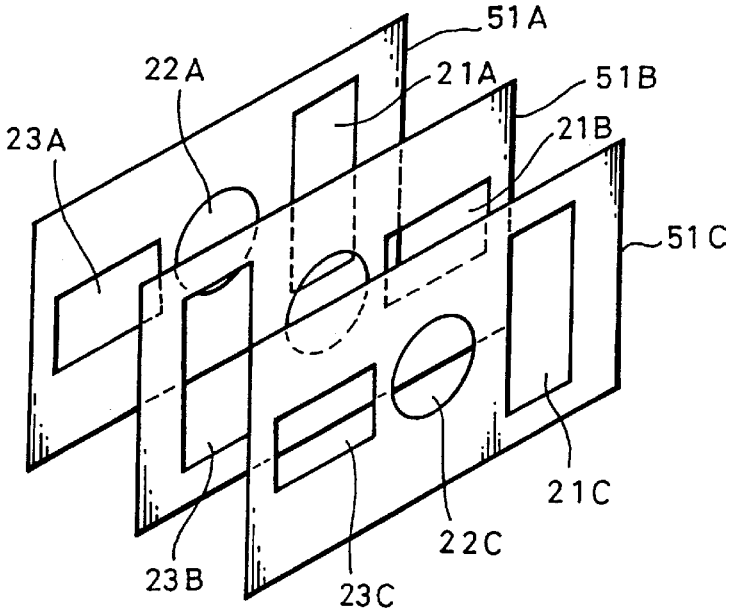

FIG. 9A is a cross-sectional view showing the 5-1th electrode 51 (51A, 51B, 51C) cut by the horizontal plane, and FIG. 9B is a schematic perspective view showing the manner in which passing apertures corresponding to the three electron beams are defined through the focusing electrode portions 51A, 51B, 51C.

As shown in FIGS. 8A to 8C and in FIGS. 9A, 9B, electron beam passing apertures 21A, 21B, 21C (electron beam R passes in this embodiment) defined on one end sides of the respective focusing electrode portions 51A, 51B, 51C are of the astigmatizer shape different from that of electron beam apertures 23A, 23B, 23C (electron beam B passes in this embodiment) defined on the other sides. In this embodiment, such astigmatizer shape is arranged as a longitudinally-oblong rectangular shape and a horizontally-oblong rectangular shape. Further, electron beam passing apertures defined on both ends of the respective focusing electrode portions are of the astigmatizer shape different from that of the electron beam apertures defined on the end faces opposing the focusing electrode portions adjacent to the above focusing electrode portions.

To be more concrete, the electron beam passing apertures 21A, 23A defined on both ends of the first focusing electrode portion 51A are of the astigmatizer shape opposite to those of the electron beam passing apertures 21B, 23B defined on both sides of the opposing second focusing electrode 51B. The electron beam passing apertures 21B, 23B defined on both ends of the second focusing electrode portion 51B are of the astigmatizer shape opposite to those of the electron beam apertures 21C, 23C defined on both ends of the opposing third focusing electrode 51C.

Specifically, the electron beam passing apertures 21A, 21C (electron beam R passes in this embodiment) defined on one end sides of the first and third focusing electrode portions 51A, 51C are vertically-oblong rectangular in shape, the central electron beam passing apertures 22A, 22C (electron beam G passes in this embodiment) are circular in shape, and the electron beam passing apertures 23A, 23C (electron beam B passes in this embodiment) defined on the other end sides are horizontally-oblong rectangular in shape. On the other hand, the electron beam passing aperture 21B(electron beam R passes in this embodiment) defined on one side of the second focusing electrode portion 51B is horizontally-oblong rectangular in shape, the central electron beam passing aperture 22B (electron beam G passes in this embodiment) is circular in shape, and the electron beam passing aperture 23B (electron beam B passes in this embodiment) defined on the other end side is vertically-oblong rectangular in shape.

Further, in this embodiment, an amplitude ($2\times V_{DQ}$) of the waveform voltage $V_F \pm V_{DQ}$ (see FIGS. 11A to 11C) may be reduced by increasing the degree of this astigmatizer, i.e. increasing a ratio $L_1/W_1$ between a long side L1 and a short side $W_1$ of the electron beam passing apertures 23A, 21B, 23C of the horizontally-oblong rectangular shape and a ratio $L_2/W_2$ of a long side $L_2$ and a short side $W_2$ of a long side $L_2$ and a short side $W_2$ of the electron beam passing apertures 21A, 23B, 21C of the vertically-oblong rectangular shape or by reducing an electrode spacing $d_1$.

When the ratio between the long side $L_1$ and the short diameter $W_1$ is increased, the ratio $L_1/W_1$ between the long side $L_1$ and the short side $W_1$ should be selected to be greater than 1.05. The ratio $L_1/W_1$ should preferably be selected in a range of from about 1.05 to 2. More preferably, the ratio $L_1/W_1$ should be selected in a range of from 1.1 to 1.5. This relationship applies for the long side $L_2$ and the short side $W_2$ as well.

When the electrode spacing d1 is reduced, if the ratio $L_1/W_1$ ranges from 1.1 to 1.5, then the electrode spacing d1 should preferably be selected in a range of from about 0.3 to 0.7 mm.

Figure 20A:
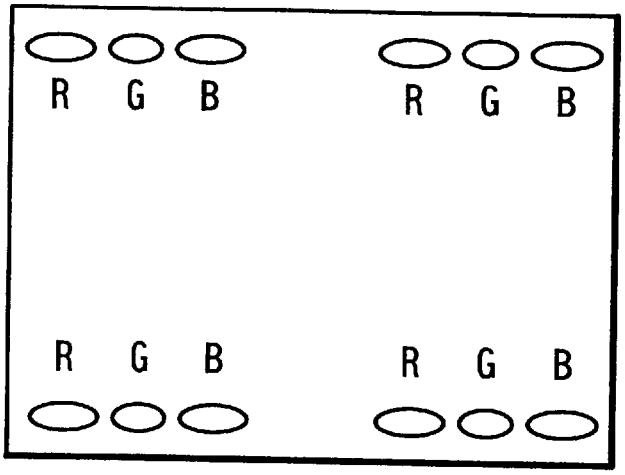
FIG. 20A is a schematic diagram showing the manner in which beam spots of electron beams are formed on the fluorescent screen by the electron gun shown in FIG. 16.
Figure 20B:
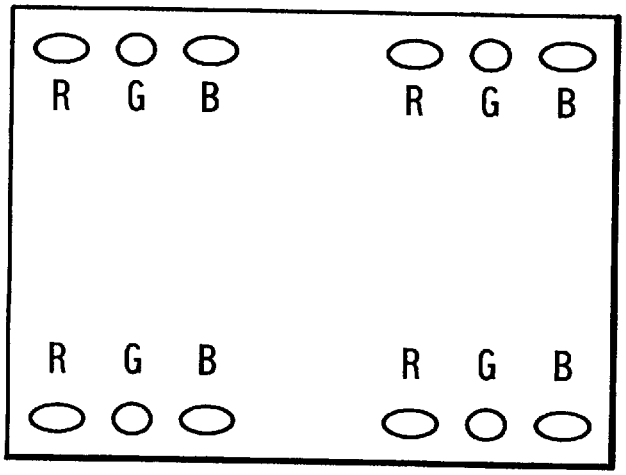
FIG. 20B is a schematic diagram showing the manner in which beam spots of electron beams are formed on the fluorescent screen by the electron gun shown in FIG. 19.

If the ratios $L_1/W_1$, $L_2/W_2$ and the electrode spacing d1 are determined as described above, then the lens produced among the electrodes 51A, 51B, 51C to affect the central electrode beam (green electron beam G in this embodiment) is weakened so that the beam spot of the central electron beam G is hardly deteriorated even in the structures shown in FIGS. 20A, 20B.

As mentioned before, the focusing voltage VF is applied through the stem portion to the first and third focusing electrode portions 51A, 51C. The voltage ($V_F \pm V_{DQ}$) in which the dynamic quadruple voltage $V_{DQ}$ having the waveform synchronized with the horizontal deflection of the focusing voltage $V_F$ applied to the first and third focusing electrode portions 51A, 51C, e.g. waveforms (see FIGS. 11A to 11C) analogous to a sawtooth waveform and the focusing voltage $V_F$ are superimposed upon each other is applied to the second focusing electrode portion 51B. Thus, the first, second and third focusing electrode portions 51A, 51B, 51C effect the quadruple action on the electron beams R and B passing the electron beam passing apertures 21A, 22A, 23A and the electron beam apertures 21C, 22C, 23C.

Figure 11A:
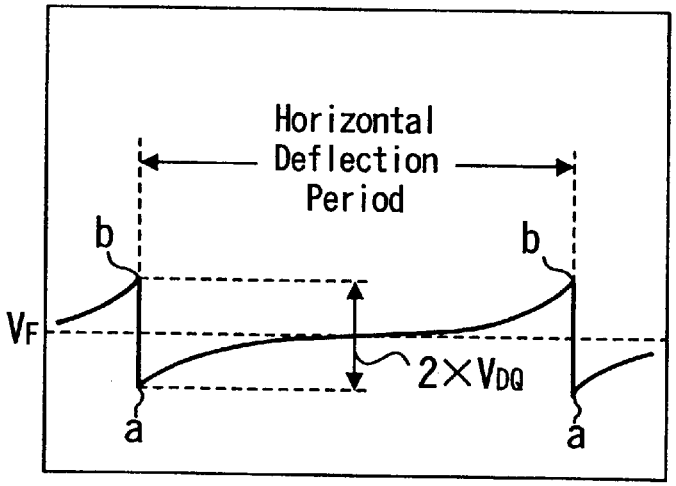
FIGS. 11A, 11B, 11C are diagrams showing examples of waveforms of a dynamic quadruple voltage used in the electron gun shown in FIG. 7, respectively.
Figure 11B:
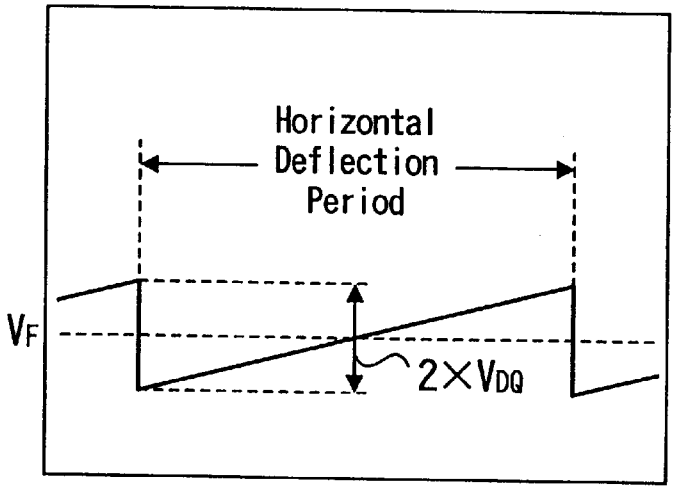
Figure 11C:
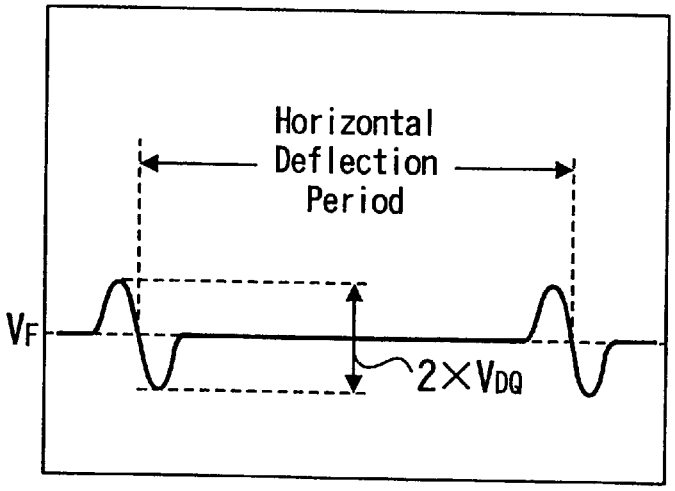

FIGS. 11A, 11B, 11C show examples of the waveform voltage $V_F \pm V_{DQ}$.

FIG. 11A shows a waveform analogous to a sawtooth waveform and which changes in a curved fashion.

FIG. 11B shows a waveform analogous to a sawtooth waveform and which changes in a linear fashion.

FIG. 11C shows a waveform of a sine waveform shape which intermittently occurs per period of a horizontal deflection period.

With respect to the three electron beams which impinge upon the fluorescent screen of the cathode-ray tube, these waveforms may effect the divergence action of the vertical direction in the quadruple action on the electron beams near the end of the horizontal direction of the fluorescent screen and may effect the convergence action of the vertical direction in the quadruple action on the electron beams far from the end of the horizontal direction of the fluorescent screen. In particular, since the deterioration of the beam spot shape of the electron beam is remarkable at the right and left ends of the fluorescent screen, even the waveform shown in FIG. 11C is effective sufficiently. Accordingly, any of the waveforms may execute the dynamic focusing when applied to the above-mentioned embodiment.

In this embodiment, a pseudo-parabolic waveform analogous to a sawtooth waveform and which is illustrated in FIG. 11A was used as the dynamic quadruple voltage $V_{DQ}$.

That is, as shown in FIG. 11A, when the electron beams passing the electron beam passing apertures 21A, 22A, 23A defined on one end sides of the respective focusing electrode portions 51A, 51B, 51C impinge upon the horizontal end portion sides of the fluorescent screen of the cathode-ray tube as compared with the electron beams passing the electron beam passing apertures 21C, 22C, 23C defined on other end sides of the respective focusing electrode portions, the voltage applied to the second focusing electrode portion 51B is higher than the voltages applied to the first and third focusing electrode portions 51A, 51C (see the state b in FIG. 11A). To be more concrete, when the three electron beams impinge upon the right-hand end side of the fluorescent screen, the voltage $V_F + V_{DQ}$ is applied to the second focusing electrode portion 51B (the state b in FIG. 11A) so that the electron beam R near the horizontal direction end portion of the fluorescent screen is affected by the divergence action of the vertical direction in the quadruple action. That is, the electron beam R obtained immediately after it has passed the 5-1th electrode has a vertically-oblong cross-section. On the other hand, the electron beam B far from the end portion of the horizontal direction of the fluorescent screen is affected by the convergence action of the vertical direction in the quadruple action. That is, the electron beam B obtained immediately after it has passed the 5-1th electrodes 51A, 51B, 51C has a horizontally-oblong cross-section.

Incidentally, "divergence action of vertical direction" means that the divergence action (concave lens effect) is effected in the vertical direction of the electron beam and the convergence action (convex lens effect) is effected in the horizontal direction of the electron beam. Also, "convergence action of vertical direction" means that the convergence action (convex lens effect) is effected in the vertical direction of the electron beam and the divergence action (concave lens effect) is effected in the horizontal direction of the electron beam.

On the other hand, when the electron beam (electron beam B) passing the electron beam passing apertures 23A, 23B, 23C defined on the other end sides of the respective focusing electrode portions(5-1Ath electrode 51A, 5-1Bth electrode 51B and 5-1Cth electrode 51C) impinges upon the end portion side of the horizontal direction of the fluorescent screen of the cathode-ray tube as compared with the electron beam (electron beam R) passing the electron beam apertures 21A, 21B, 21C defined on one end sides of the respective focusing electrode portions 51A, 51B, 51C, the voltage applied to the second focusing electrode portion (5-1Bth electrode 51B) is lower than the voltages applied to the first and third focusing electrode portions (5-1Ath electrode 51A and 5-1Cth electrode 51C)(see the state a in FIG. 11A). To be more concrete, when the three electron beams impinge upon the left-hand end side of the fluorescent screen, since the voltage $V_F-V_{DQ}$ is applied to the second focusing electrode portion (5-1Bth electrode 51B) (state a in FIG. 11A), the electron beam relative to the electron beam B near the end portion of the horizontal direction of the fluorescent screen is affected by the divergence action of the vertical direction in the quadruple action. On the other hand, the electron beam R far from the end portion of the horizontal direction of the fluorescent screen is affected by the convergence action of the vertical direction in the quadruple action.

As mentioned before, the voltage (VF+VDF) in which the dynamic focusing voltage VDF (see FIG. 10) synchronized with the horizontal deflection of the focusing voltage VF applied to the 5-1Cth electrode 51C and the focusing voltage VF are superimposed upon each other is applied to the third electrode 13 and the 5-2th electrode 52, whereby the quadruple lens is formed between the 5-1Cth electrode 51C and the 5-1Bth electrode 51B. In addition, the focus lens formed between the 5-2th electrode 52 and the sixth electrode 16 is changed in intensity. As a result, the shapes of the electron beams on the right and left peripheral portions of the fluorescent screen may be made satisfactory.

The quadruple effects exerted upon the electron beams by the respective focusing electrode portions (5-1Ath electrode 51A, 5-1Bth electrode 51B and 5-1Cth electrode 51C) may cancel a difference of degrees of the convergence action and the divergence action dependent upon the position at which the three electron beams pass the deflection yoke 2 and which affect the electron beams in the magnetic field of the deflection yoke 2. That is, when the three electron beams, for example, impinge upon the right-hand end portion of the fluorescent screen of the cathode-ray tube, the electron beam R which is shaped as vertically-oblong by the quadruple lens formed between the 5-1Cth electrode 51C and the 5-2th electrode 52 is affected in the magnetic field of the deflection yoke 2 more strongly by a larger convergence action in the vertical direction as compared with the electron beam B. Therefore, the cross-section of the electron beam R was already made vertically-oblong by the 5-1th electrode. On the other hand, in the magnetic field of the deflection yoke 2, the electron beam B is affected by a small convergence action in the vertical direction as compared with the electron beam R. Therefore, the cross-section of the electron beam B was already made horizontally-oblong by the 5-1th electrode.

Accordingly, it is possible to cancel a difference of degrees of the convergence action and the divergence action which have affected the electron beams R, B in the magnetic field of the deflection yoke 2.

As a consequence, the states of the beam spots of the three electron beams on the right and left peripheral portions of the fluorescent screen 4 may be made uniform. Therefore, it is possible to reliably avoid red characters from becoming unclear on the right-hand side of the fluorescent screen 4 and to reliably avoid blue characters from becoming unclear on the left-hand side of the fluorescent screen 4.

Further, the shapes of the electron beam passing apertures having the astigmatizer shapes defined on both end sides of the respective focusing electrodes 51A, 51B, 51C are not limited to the combination of the aforementioned vertically-oblong rectangular shape/horizontally-oblong rectangular shape.

Figures 12A, 12B, 12C:
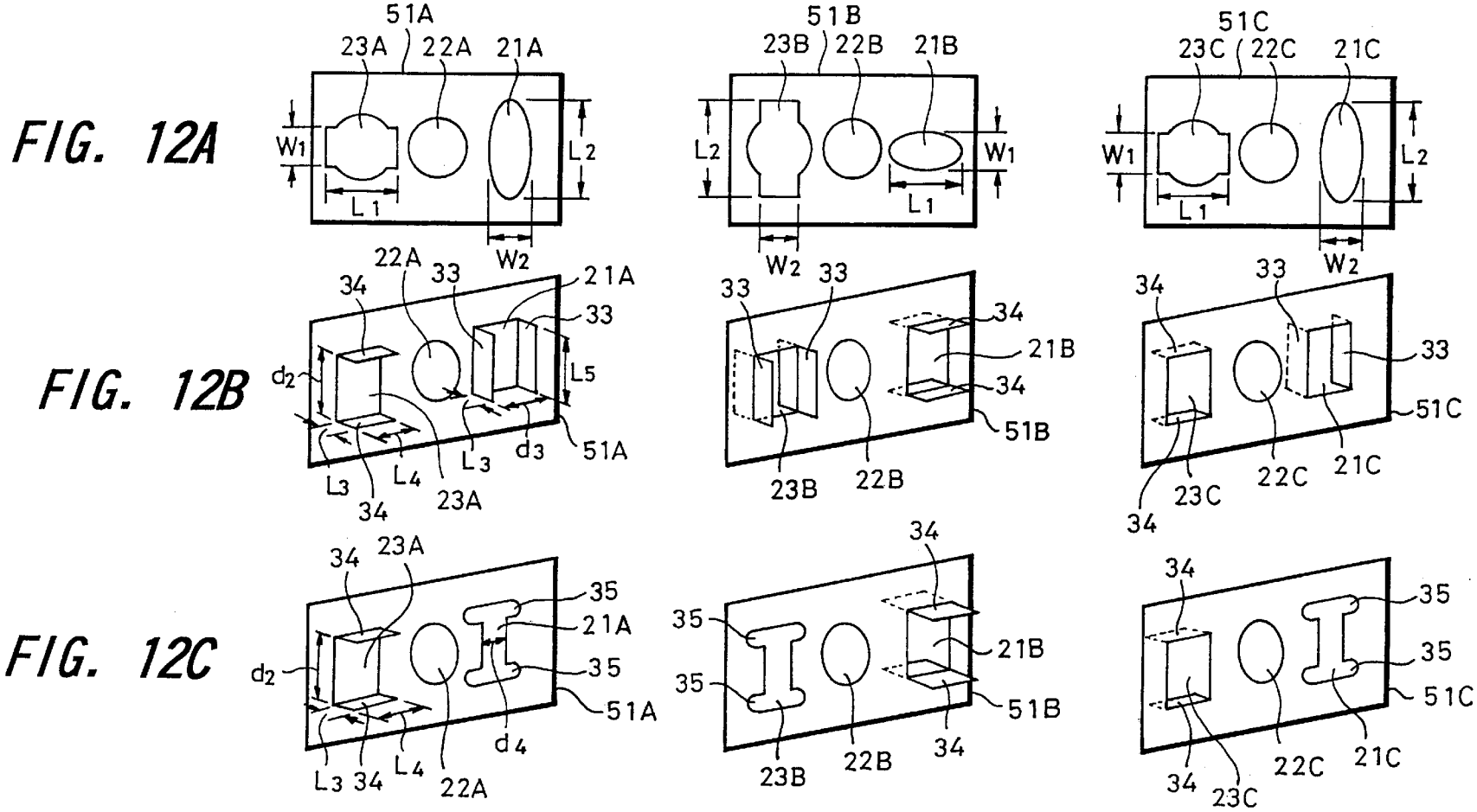
FIGS. 12A, 12B, 12C are schematic diagrams showing other examples of the shape of the 5-1th electrode of the electron gun shown in FIG. 7, respectively.

FIGS. 12A to 12C show the arrangements of electrodes other than the electrodes in which the shapes of the electron beam apertures on the opposing surfaces of the three portions of the 5-1Ath electrode 51A, the 5-1Bth electrode 51B, the 5-1Cth electrode 51C are comprised of the shapes shown in FIGS. 8 and 9, i.e. vertically-oblong and horizontally-oblong rectangular shapes, electron beam (R in FIG. 8) passing aperture of one outside is shaped as vertically-oblong (21A), horizontally-oblong (21B), vertically-oblong (21C) from the cathode side and electron beam (B in FIG. 8) passing aperture of another outside is shaped as horizontally-oblong (23A), vertically-oblong (23B), horizontally-oblong (23C), respectively.

As shown in FIG. 12A, for example, the electron beam passing apertures 21A, 21B, 21C defined on one end side may be shaped as ellipse in which a major axis is coincident with the vertical direction/ellipse in which a minor axis is coincident with the vertical direction. Also, the electron beam passing apertures 23A, 23B, 23C defined on the other end side may be shaped as a combination of a vertically-oblong rectangle and a circle and a combination of a horizontally-oblong rectangle and a circle.

The shapes of the apertures are not limited to the above-mentioned ones, and may be combinations of vertically-oblong rectangle/square, vertically-oblong rectangle/circle, square/horizontally-oblong rectangle, circle/horizontally-oblong rectangle, ellipse in which a major axis is coincident with the vertical direction/circle, circle/ellipse in which a minor axis is coincident with the vertical direction and arbitrary vertically-oblong shape/horizontally-oblong shape.

Alternatively, as other examples of shapes of apertures, there may be used shapes which are formed by combinations of screen-like protruded portions.

Specifically, as shown in FIG. 12B, screen-like protruded portions 33 may be formed on the right and left outer peripheral portions of the electron beam passing apertures 21A, 21C defined on one end sides of the first and third focusing electrode portions 51A, 51C. The central electron beam passing apertures 22A, 22C may be circular in shape. Screen-like protruded portions 34 may be formed on the upper and lower outer peripheral portions of the electron beam apertures 23A, 23C defined on the other end sides. Screen-like protruded portions 34 may be formed on the upper and lower outer peripheral portions of the electron beam passing aperture 21B defined on one end side of the second focusing electrode portion 51B. The central electron beam passing aperture 22B may be circular in shape. Screen-like protruded portions 33 may be formed on the right and left outer peripheral portions of the electron beam passing aperture 23B defined on the other end side.

Then, in the arrangement shown in FIG. 12B, by increasing height $L_3$ of the screen-like protruded portions 33 or increasing lengths $L_4$, $L_5$ of the screen-like protruded portions 34 and 33 or reducing spaces $d_2$, $d_3$ between the screen-like protruded portions 34, 33 and or narrowering the distance (above-said $d_1$) between the screen-like protruded portions 33 or by the combinations of the aforementioned arrangements, a sufficient astigmatizer degree may be provided, thereby making it possible to alleviate the influence exerted upon the central electron beam from the dynamic quadruple voltage $V_{DQ}$.

Further, as other examples of the shapes of the apertures, it is possible to use the shapes of the combinations of the screen-like protruded portions 34 and insertion apertures 35 into which the protruded portions 34 are inserted.

Specifically, as shown in FIG. 12C, insertion apertures 35 may be defined on the upper and lower outer peripheral portions of the electron beam passing apertures 21A, 21C defined on end sides of the first focusing electrode portion (5-1Ath electrode 51A) and the third focusing electrode portion (5-1Cth electrode 51C). The central electron beam passing apertures 22A, 22C may be circular in shape. The screen-like protruded portions 34 may be formed on the upper and lower outer peripheral portions of the electron beam passing apertures 23A, 23C defined on the other end side. The screen-like protruded portions 34 which are inserted into the insertion apertures 35 defined on one end sides of the first and third focusing electrodes may be formed on the upper and lower outer peripheral portions of the electron beam passing aperture 21B defined on one end side of the second focusing electrode portion (5-1Bth electrode 51B). The central electron beam passing aperture 22B may be circular in shape. The insertion apertures 35 into which the protruded portions 34 formed on the other end sides of the first and third focusing electrode portions may be formed on the upper and lower outer peripheral portions of the electron beam passing aperture 23B formed on the other end side.

Then, in the arrangement shown in FIG. 12C, by increasing the height $L_3$ of the screen-like protruded portion 34 or increasing the length $L_4$ of the screen-like protruded portion 34 or reducing the space d2 between the screen-like protruded portions 34 or reducing a width $d_4$ of the insertion aperture, increasing the thickness of the electrode or reducing the distance d1 between the electrodes or by using the combinations of the above-mentioned arrangements, a sufficient astigmatizer degree may be provided, thereby making it possible to alleviate the influence exerted upon the central electron beam from the dynamic quadruple voltage $V_{DQ}$.

In the electrode arrangements shown in FIGS. 12A to 12C, of the 5-1th electrode that has been divided by three, the shapes of the apertures on both sides of the central 5-1Bth electrode 51B, i.e. shapes of the passing apertures 21B and 23B may be selected to be real circles similarly to the central aperture 22B of the 5-1Bth electrode 51B.

Figure 13:
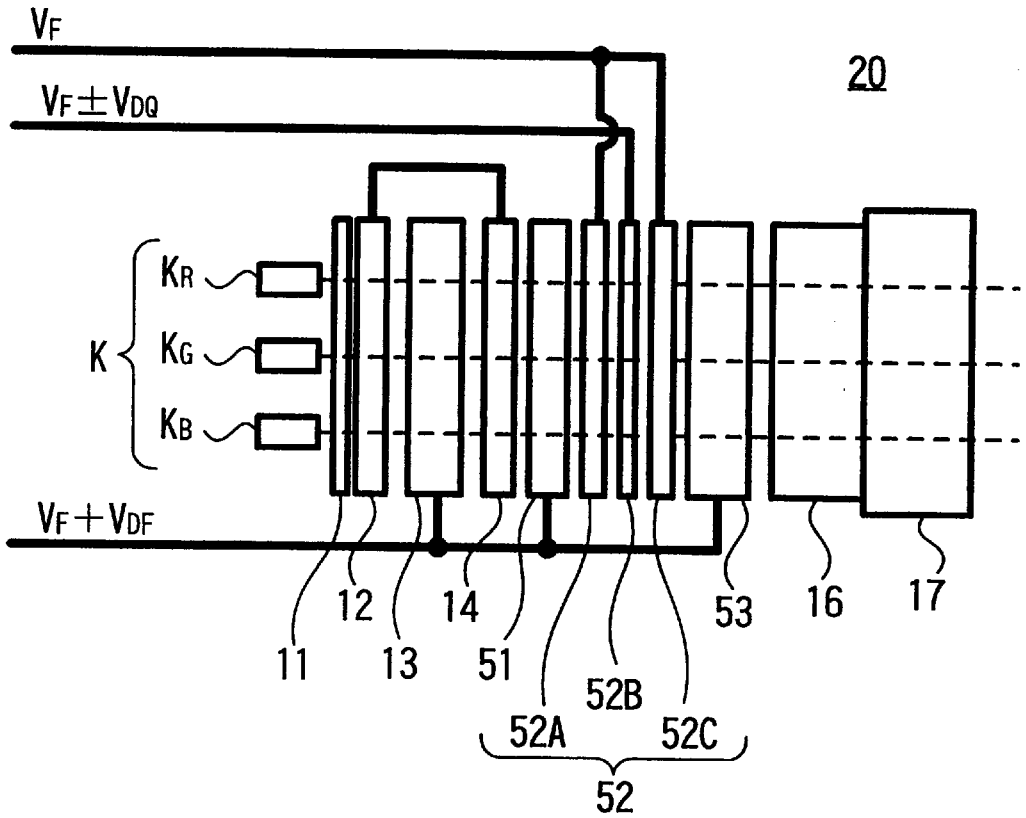
FIG. 13 is a schematic diagram showing the layout of electrodes of an electron gun according to other embodiment of the present invention.

FIG. 13 shows a color cathode-ray tube electron gun according to other embodiment of the present invention wherein the fifth electrode is divided by three to provide a 5-1th electrode 51, a 5-2th electrode 52 and a 5-3th electrode 53 and a central 5-2th electrode 52 is further divided by three.

As shown in FIG. 13, in an electron gun 20 according to this embodiment, the fifth electrode is divided by three to provide the 5-1th electrode 51, the 5-2th electrode 52 and the 5-3th electrode 53. Further, the 5-2th electrode 52 which corresponds to the focusing electrode is divided by three to provide a first focusing electrode portion (5-2Ath electrode) 52A, a second focusing electrode portion (5-2Bth electrode) 52B and a third focusing electrode portion (5-2Cth electrode) 52C.

The focusing voltage $V_F$ is applied to the 5-2Ath electrode 52A and the 5-2Cth electrode 52C. The voltage ($V_F \pm V_{DQ}$) in which the dynamic quadruple voltage $V_{DQ}$ and the focusing voltage $V_F$ are superimposed upon each other is applied to the 5-2Bth electrode 52B.

Figure 2:
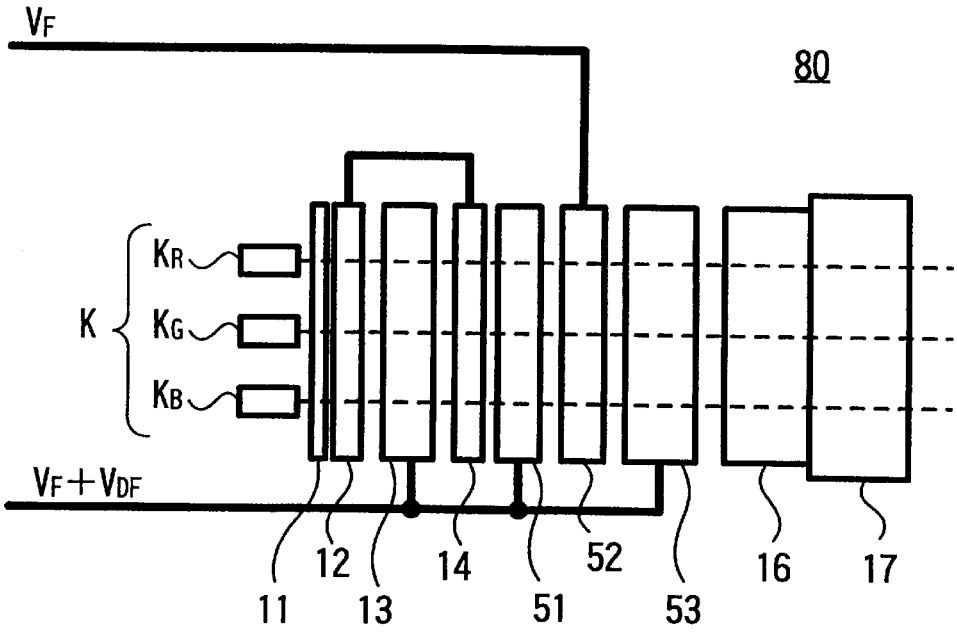
FIG. 2 is a schematic diagram showing another example of a color cathode-ray tube electron gun housing a quadruple lens therein according to the prior art.
Figure 3A:
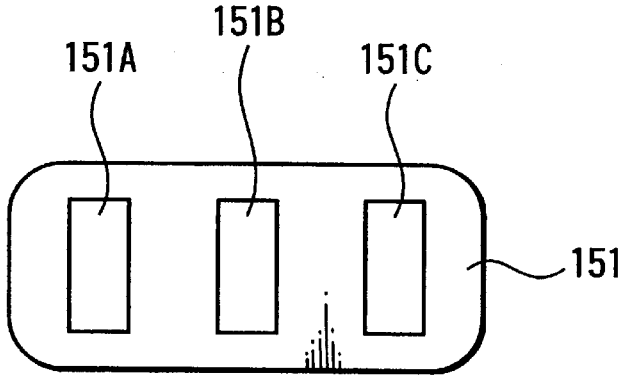
FIGS. 3A and 3B are schematic diagrams showing electrodes forming quadruple lenses used in the electron guns shown in FIGS. 1 and 2.
Figure 3B:
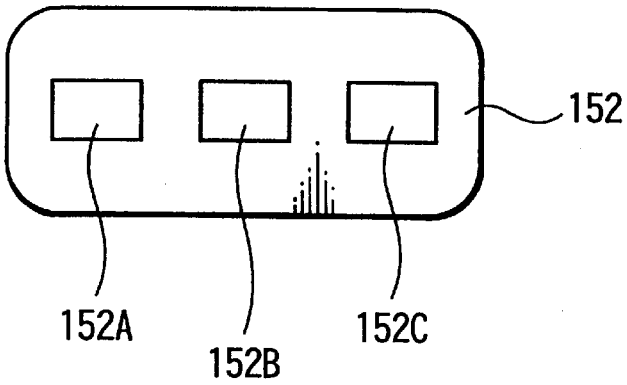
Figure 4:
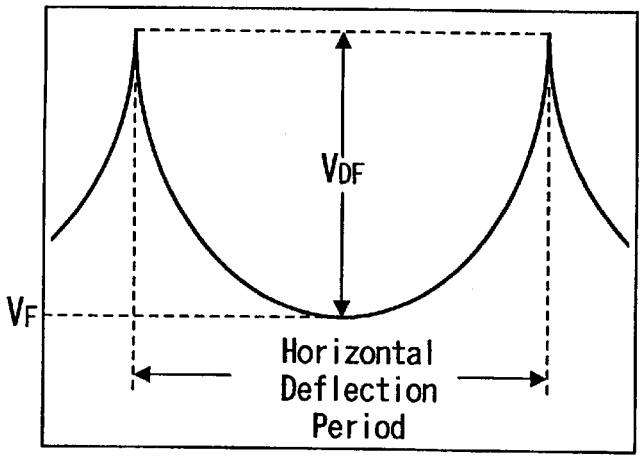
FIG. 4 is a diagram showing an example of a dynamic focusing voltage used in the electron guns shown in FIGS. 1 and 2.
Figure 5:
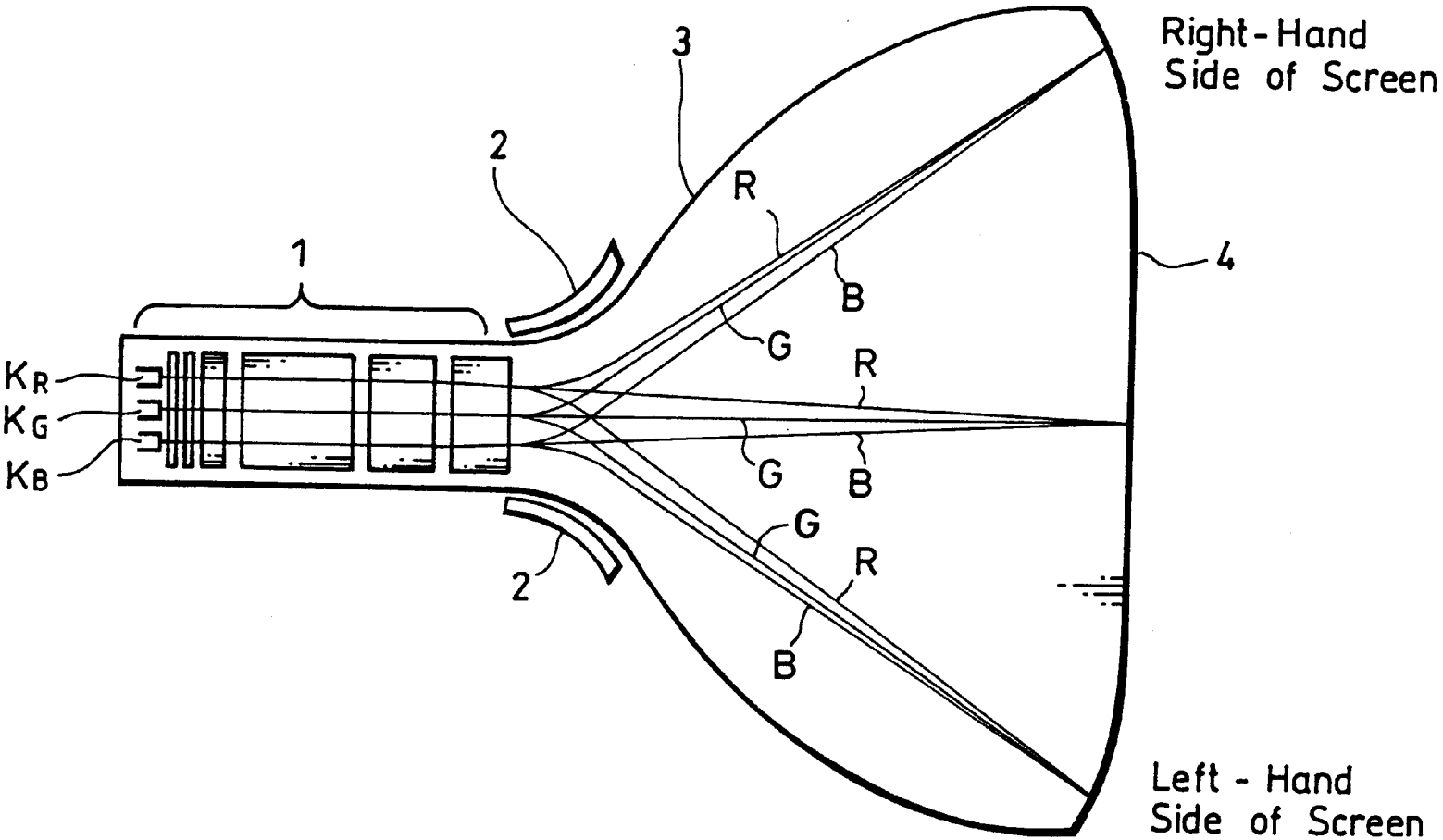
FIG. 5 is a schematic diagram showing a color cathode-ray tube.
Figure 6A:
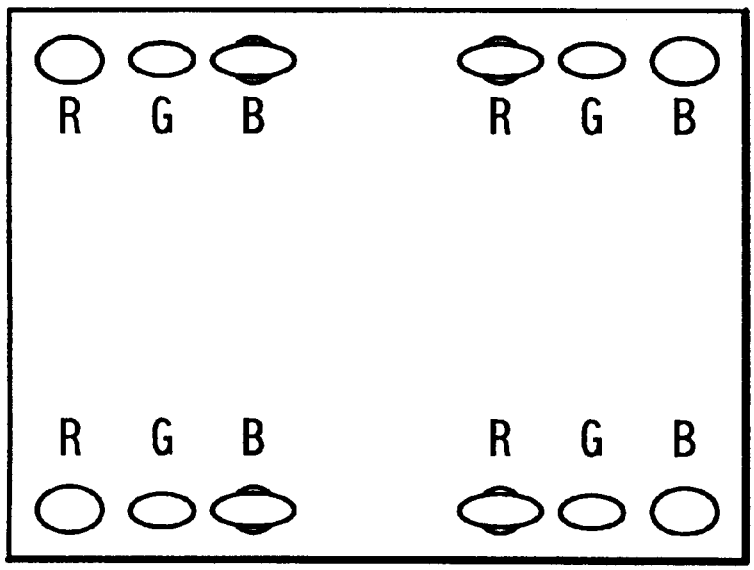
FIG. 6A is a schematic diagram showing the manner in which beam spots of electron beams are formed on the fluorescent screen by the electron gun shown in FIG. 1.
Figure 6B:
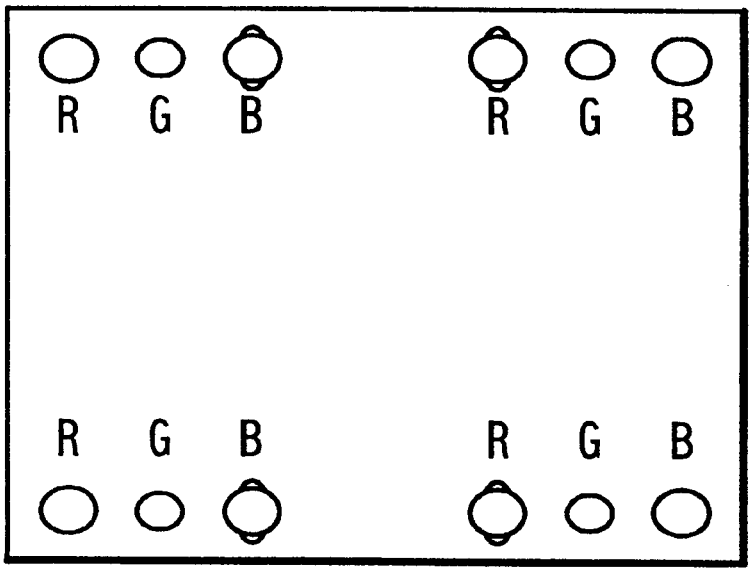
FIG. 6B is a schematic diagram showing the manner in which beam spots are formed on the fluorescent screen by the electron gun shown in FIG. 2.

Similarly to the conventional electron gun 80 shown in FIG. 2, the voltage ($V_F+V_{DF}$) in which the dynamic focusing voltage VDF synchronized with the horizontal deflection of the focusing voltage $V_F$ applied to the 5-2Ath electrode 52A and the 5-2Cth electrode 52C and the focusing voltage $V_F$ are superimposed upon each other is applied to the third electrode 13, the 5-1th electrode 51 and the 5-3th electrode 53.

Thus, the quadruple lenses which act in the opposite directions are formed between the 5-1th electrode 51 and the 5-2Ath electrode 51A and between the 5-2Cth electrode 52C and the 5-3th electrode 53. In addition, an intensity of a focusing lens formed between the 5-3th electrode 53 and the sixth electrode 16 is changed by the quadruple lenses thus formed.

As a result, the shapes of the electron beams at the right and left peripheral portions of the fluorescent screen may be made more satisfactory.

Therefore, it is possible to more reliably avoid red characters from becoming unclear on the right-hand side of the fluorescent screen and also to more reliably avoid blue characters from becoming unclear on the left-hand side of the fluorescent screen.

For comparison, there will be described an electron gun already proposed which affects a red electron beam and a blue electron beam with quadruple lens effects having different intensities.

Figure 16:
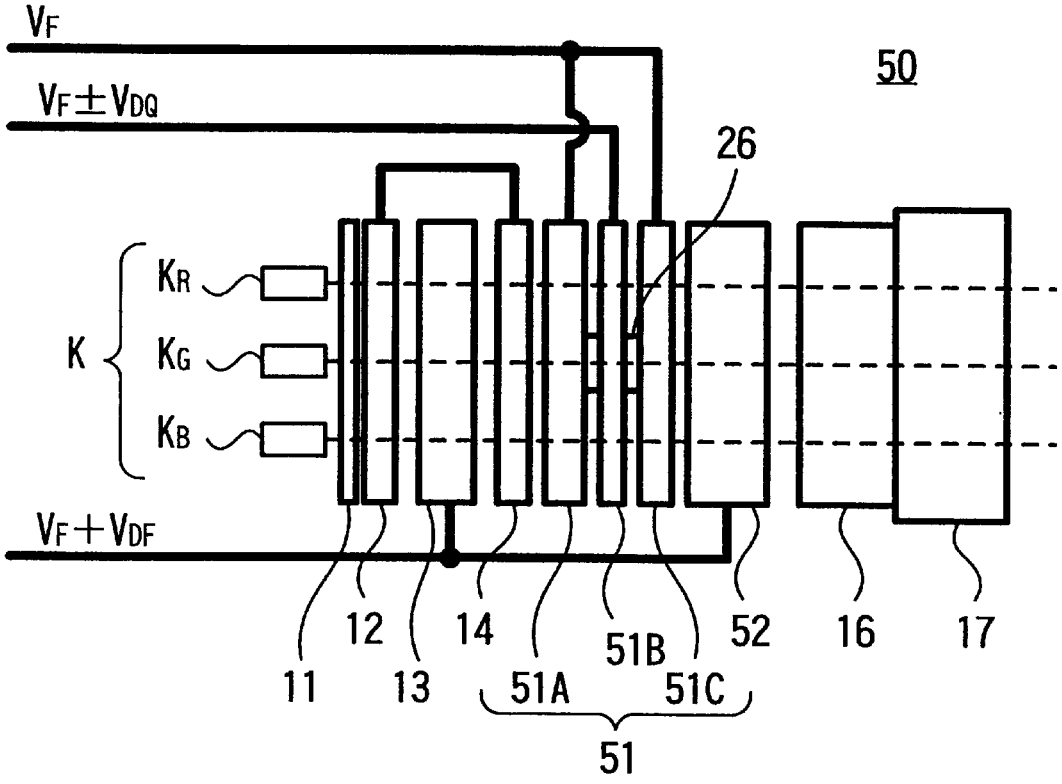
FIG. 16 is a schematic diagram showing a comparative example of a color cathode-ray tube electron gun housing a quadruple lens therein.

In an electron gun 50 shown in FIG. 16, as compared with the electron gun 10 according to the present invention shown in FIG. 7, in the central electron beam G passing aperture, a protruded portion is formed from any one of the electrodes 51A, 51C disposed at the front or rear of the 5-1th electrode divided by three, and a shielding member 26 formed of the protruded member is inserted into the passing apertures of the central electron beam G of other remaining two 5-1th electrodes.

A rest of the arrangement of the electron gun 50 is similar to that of the electron gun 10 shown in FIG. 7. Thus, in FIG. 16, elements and parts identical to those of FIG. 7 are marked with the same reference numerals and therefore need not be described in detail.

Figure 17A:
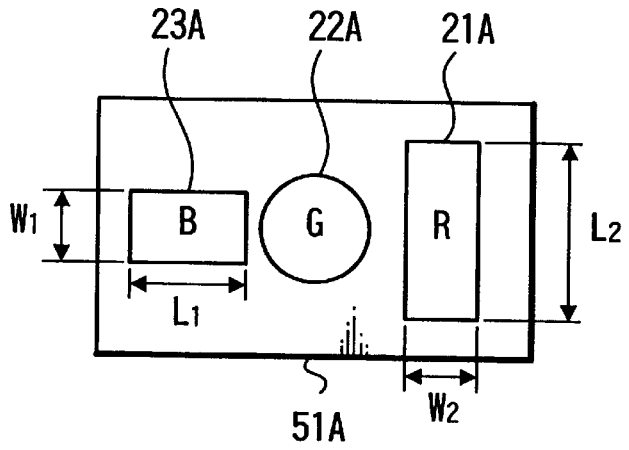
FIGS. 17A, 17B, 17C are schematic diagrams showing examples of the shapes of the 5-1th electrode of the electron gun shown in FIG. 16, respectively.
Figure 17B:
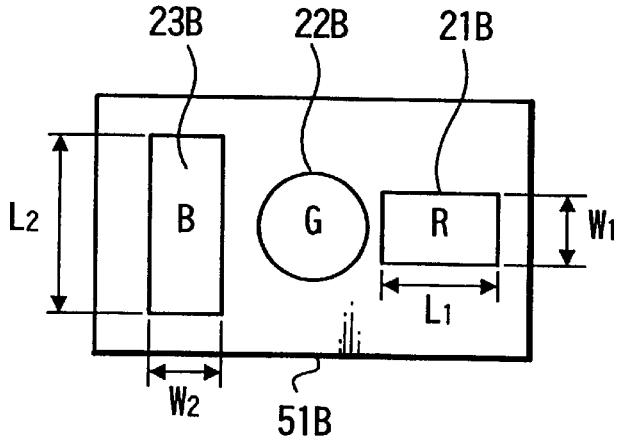
Figure 17C:
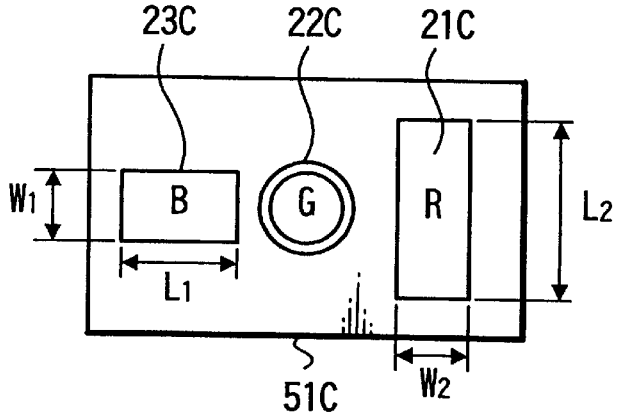
Figure 18A:
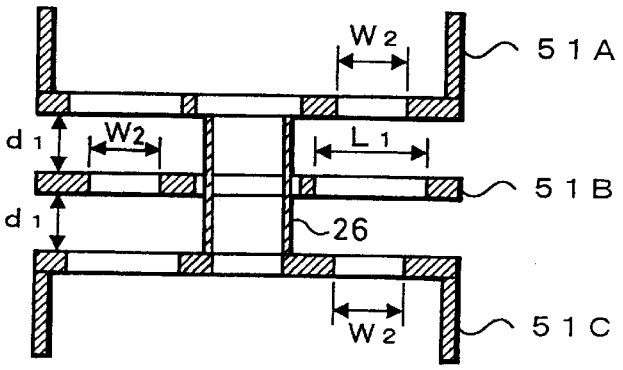
FIGS. 18A, 18B are a cross-sectional view and a perspective view showing a positional relationship of the 5-1th electrode of the electron gun shown in FIG. 16, respectively.
Figure 18B:
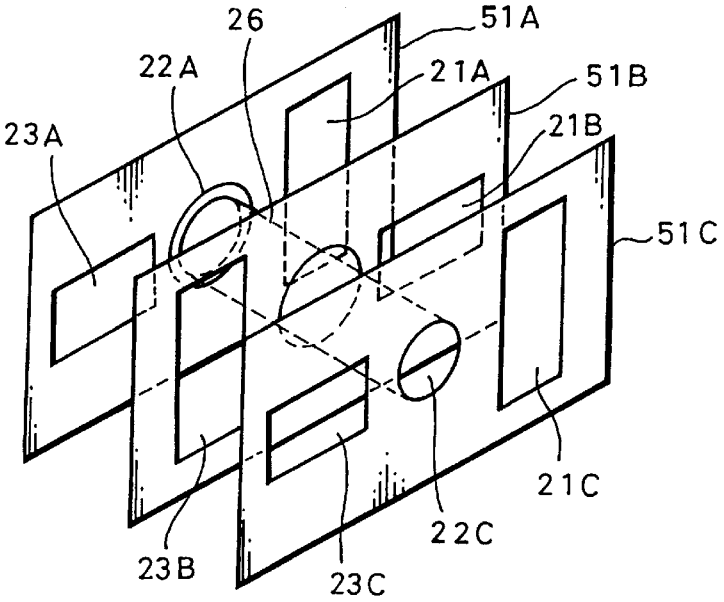

FIGS. 17A to 17C shows examples of shapes of electron beam passing apertures of the 5-1th electrodes in this electron gun 50. FIG. 18A is a cross-sectional view of the 5-1th electrode, and FIG. 18B is a schematic perspective view showing the layout of the 5-1th electrodes.

Figure 19:
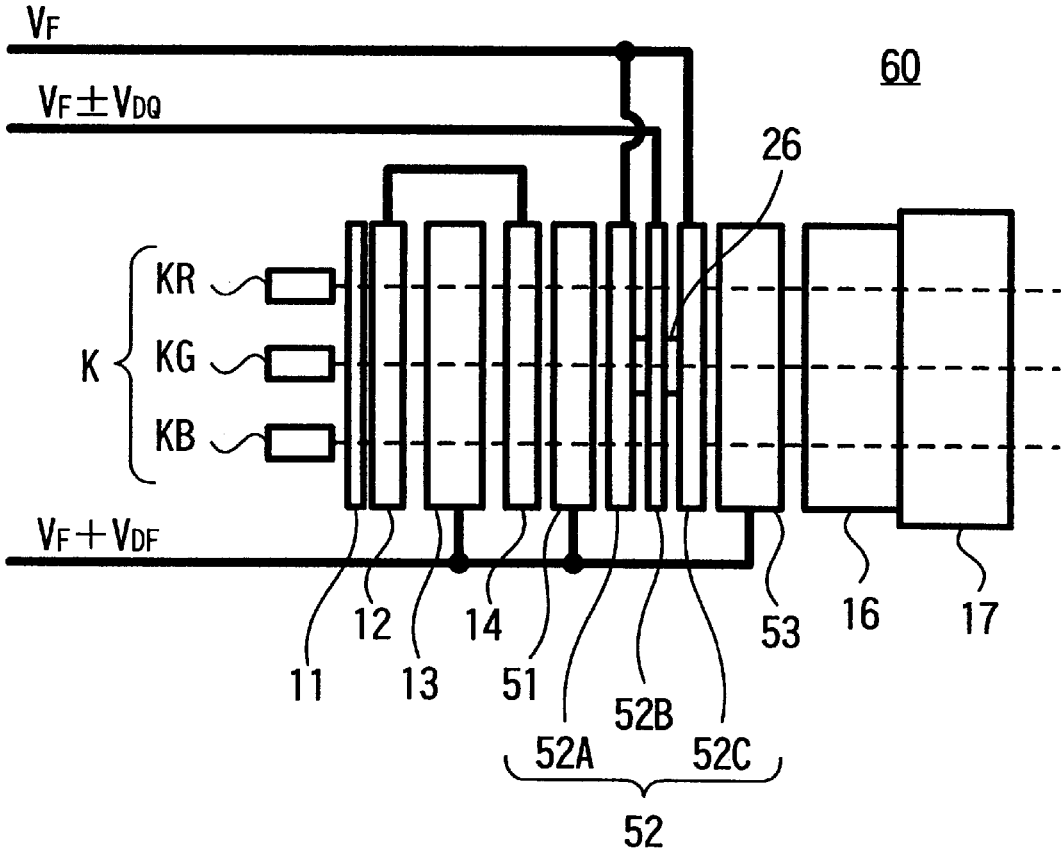
FIG. 19 is a schematic diagram showing another comparative example of a color cathode-ray tube electron gun housing a quadruple lens therein.

FIG. 19 shows an example of an electron gun 60 in which the shielding member 26 is similarly formed in the electron gun 20 according to the present invention shown in FIG. 13.

In these electron guns 50, 60, since the central electron beam is protected by the shielding member 26, the central electron beam can be protected from the influence of the dynamic quadruple voltage $V_{DQ}$ so that the shapes of the three beams may become substantially satisfactoryas shown in FIGS. 20A and 20B. Incidentally, FIG. 20A shows the state of the beam spots obtained by the electron gun 50 shown in FIG. 16, and FIG. 20B shows the state of the beam spots obtained by the electron gun 60 shown in FIG. 19.

In general, one of the problems encountered with the above-mentioned structure is that a focusing voltage difference occurs between two electron beams R and B due to a difference between the shapes of the passing apertures of the red electron beam R and the blue electron beam B.

As a result, either of or both of the spots of the red electron beam R and the blue electron beam B become unsatisfactory on the whole of the screen.

Further, another problem encountered with the above-mentioned structure is that the shielding member 26 for shielding the central green electron beam passing aperture should be formed, resulting in the structure of parts becoming complicated.

In the above-mentioned electron guns 10, 20 according to the present invention, with respect to the aspect ratio of the openings of the electron beams R, B of the outsides of the focusing electrode, the long diameter/short diameter is selected to be greater than 1.05, whereby a sufficient astigmatizer shape may be presented. Thus, the influence exerted upon the central electron beam from the dynamic quadruple voltage VDQ may be reduced. Therefore, the shielding member 26 need not be formed in the central electron beam passing aperture unlike the electron guns 50, 60 of the comparative examples.

Accordingly, the shapes of the parts of the electron gun may be simplified and the manufacturing process may be simplified, thereby resulting in the manufacturing cost being reduced.

FIGS. 14A to 14D are schematic diagrams (cross-sectional views of main portions) showing an electron gun according to a further embodiment of the present invention, respectively.

FIGS. 14A to 14D are respectively cross-sectional views showing the 5-1th electrodes 51A, 51B, 51C thus divided by three in an enlarged scale. Other arrangement, e.g. the layout of the electrodes may be made similar to those of the electron gun 10 shown in FIG. 7.

In the electrode structures shown in FIGS. 14A to 14D, of the 5-1th electrodes divided by three shown in FIGS. 7 to 9, the first and third electrodes, i.e. the 5-1Ath electrode 51A and the 5-1Cth electrode 51C are extended in the opposite direction of the opposing side of the central 5-1th electrode 51B and also in parallel to the traveling direction of electron beams, thereby resulting in the length L of the same potential portion being made sufficiently long.

Figure 14A:
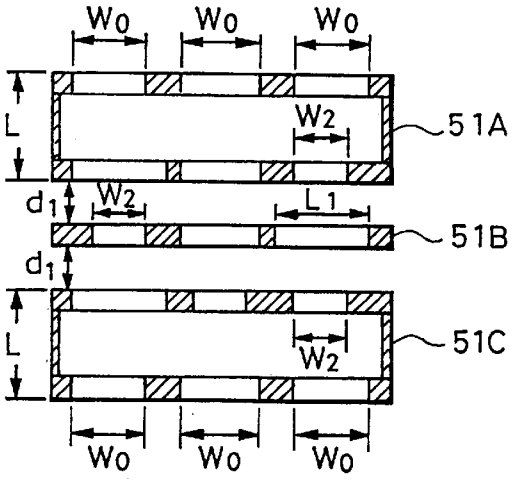
FIGS. 14A through 14D are schematic diagrams showing the electron gun according to further embodiments of the present invention, respectively.
Figure 14B:
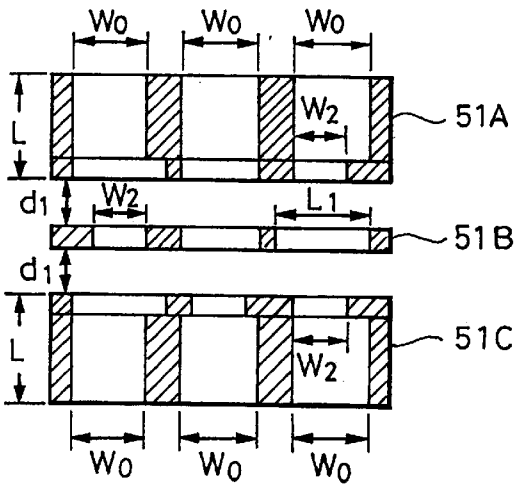
Figure 14C:
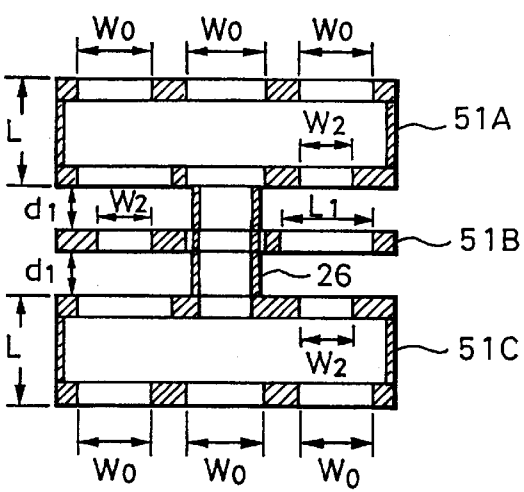
Figure 14D:
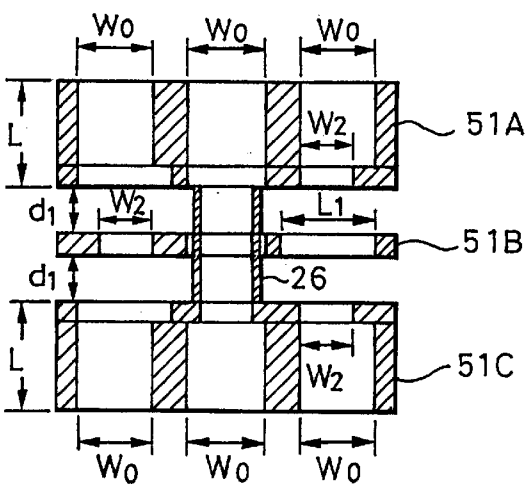

FIGS. 14A and 14C show the case in which the insides of the 5-1Ath electrode 51A and the 5-1Cth electrode 51C are formed of a common cavity. FIGS. 14B and 14D show the case in which independent through-bores are respectively defined in the insides of the 5-1Ath electrode 51A and the 5-1Cth electrode 51C in response to the three electron beams. Also, FIGS. 14C and 14D show the case in which the shielding member 26 is formed on the central electron beam aperture.

With respect to the electron beam passing apertures of the opposite sides of the central 5-1Bth electrode 51B, the passing apertures corresponding to the three electron beams R,G,B should preferably be formed as openings having the same size and shape. As shown in FIGS. 14A to 14D, the passing apertures corresponding to the three electron beams should preferably have a width $W_o$ of the same cross-section and should be formed of any one of circle, square and rectangle or the like.

Since the passing apertures are formed of the openings having the same size and shape as described above, it is possible to increase an effect for making shapes of three electron beams uniform, which effect will be described later on.

To be more concrete, the length L of the same potential portion is selected to become greater than (opening minor diameter $W_1+W_o)/3$. In particular, the length L of the same potential portion should preferably be selected to become greater than about (opening minor diameter $W_1+W_0)/2$.

While the 5-1th electrodes 51A, 51C of the outsides are both extended in FIGS. 14A to 14D as described above, the present invention is not limited thereto, and only any one of the 5-1th electrodes 51A, 51C may be extended.

Since the 5-1th electrodes 51A, 51C of the outsides are extended as described above, the actions of the quadruple lenses formed by the 5-1th electrodes 51A, 51B, 51C divided by three may protect the lens formed by the electrode 51A and the electrode (fourth electrode) 14 located above the electrode 51A or the lens formed by the electrode 51C and the electrode (5-2th electrode) 52 located under the electrode 51C from being deformed.

Figure 15A:
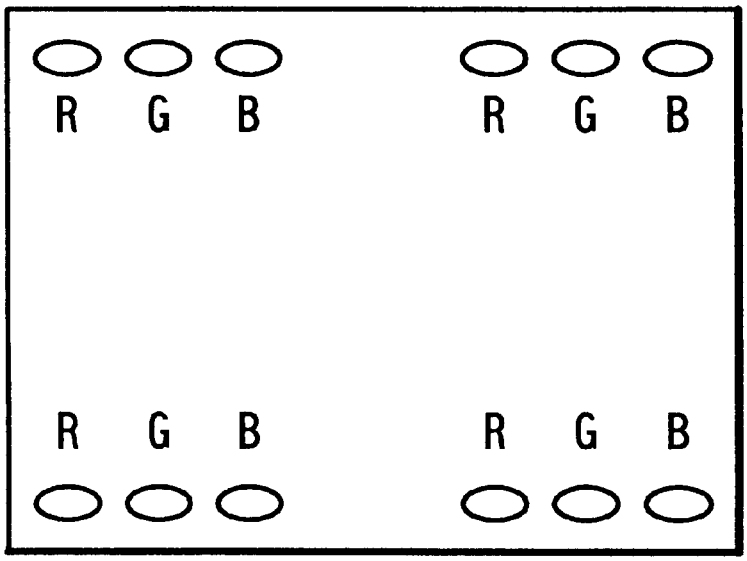
FIGS. 15A, 15B are schematic diagrams showing the manner in which beam spots of electron beams are formed on the fluorescent screen by the electron gun having the structure shown in FIG. 14, respectively.
Figure 15B:
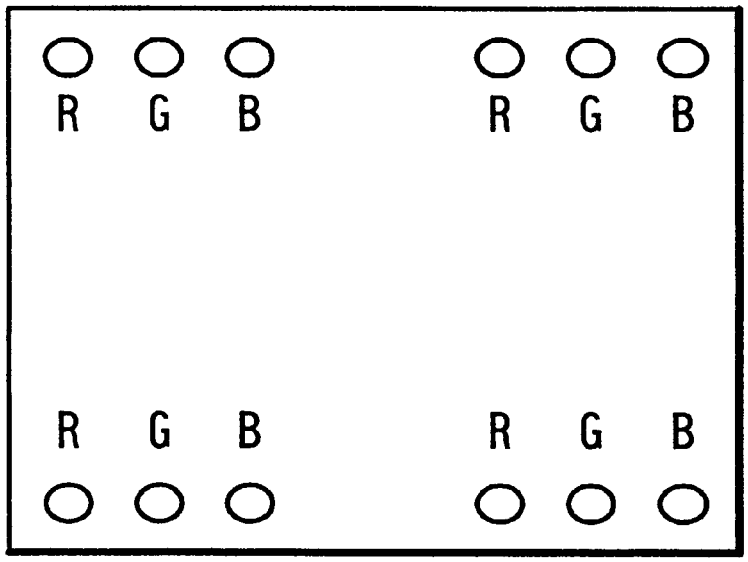

Thus, since the difference caused in the focusing voltages of the two electron beams R, B when the shapes of the passing apertures corresponding to the red electron beam R and the blue electron beam B are different may be reduced, as shown in FIGS. 15A and 15B which show the shapes of the beam spots of the electron beams formed on the fluorescent screen, the shapes of the beam spots of the three electron beams R, G, B may become more satisfactory.

FIG. 15A shows the case in which the present invention is applied to the electrode structure in which the fifth electrode is halved and one of the 5-1th electrode of the divided electrodes is further divided by three similarly to the electron gun 10 shown in FIG. 7. FIG. 15B shows the case in which the present invention is applied to the electrode structure in which the fifth electrode is divided by three and the central 5-2th electrode thereof is further divided by three similarly to the electron gun 20 shown in FIG. 13.

When the focusing electrode is divided by three, the focusing electrode portion to which the focusing voltage $V_F$ or the focusing voltage $V_F \pm V_{DQ}$ on which the dynamic quadruple voltage is superimposed is applied may be determined based on the astigmatizer shapes and the layout of the electron beam passing apertures with reference to the aforementioned embodiments.

Further, the focusing electrode and the electron beam passing aperture that should be formed as the astigmatizer shape may be determined based on the conditions whether the requirements in which the electron beam passing apertures define on one end side (e.g. side corresponding to the electron beam R in the aforementioned embodiments) of the focusing electrode portion should have astigmatizer shapes different from those of the electron beam passing apertures defined on the other end side (e.g. side corresponding to the electron beam B in the aforementioned embodiments) and in which the electron beam passing apertures defined on both end sides (e.g. sides corresponding to the electron beams R and B in the aforementioned embodiment) should have astigmatizer shapes different from those of the electron beam passing apertures defined on the opposing two end sides of the adjacent focusing electrode may be satisfied or not.

While one electrode (5-1th electrode 51 or 5-2th electrode 52) of the focusing electrode portion is divided by three as described above, the present invention is not limited thereto, and one electrode of the focusing electrode portion may be divided by two or by more than four.

Furthermore, in the focusing electrodes divided by three, with respect to the electron beam passing apertures defined on the first focusing electrode portion and the second focusing electrode portion, the requirements in which the electron beam passing apertures defined on one end side of the focusing electrode portion should have astigmatizer shapes different from those of the electron beam apertures defined on the other end side and the electron beam passing apertures defined on both end sides of this focusing electrode portion should have astigmatizer shapes different from those of the electron beam passing apertures defined on the opposing two end sides of the adjacent focusing electrode portion may be satisfied and the electron beam passing apertures defined on the third focusing electrode portion may not be formed as astigmatizer shapes.

The color cathode-ray tube electron gun according to the present invention may be applied to color cathode-ray tube electron guns of a variety of lens systems, e.g. color cathode-ray tube electron guns of bipotential focus lens type, unipotential focus lens type, high-bipotenial focus lens type, tri-potential focus lens type, high-unipotential focus lens type and unibipotential focus lens type.

According to the present invention, since the aspect ratio of the opening of the focusing electrode is set in such a manner that the major diameter/minor diameter becomes greater than 1.05 so that the central electron beam need not be shielded from the magnetic field applied to the right and left electron beams, the shielding material need not be used, and the shapes of the parts may be simplified, thereby resulting in the manufacturing cost of the color cathode-ray tube electron gun being decreased.

Furthermore, according to the present invention, since the thicknesses of the first and third focusing electrodes of the focusing electrodes divided by three are set to be greater than that of the second focusing electrode, a difference of focusing voltages applied to right and left electron beams may be reduced so that the shapes of the three electron beams may be made satisfactory on the whole areas of the picture screen simultaneously. As a result, it is possible to reliably avoid the red characters from becoming unclear on the right-hand side of the fluorescent screen and also to reliably avoid the blue characters from becoming unclear on the left-hand side of the fluorescent screen. In addition, it is possible to obtain the beam spots of satisfactory shapes on the whole of the fluorescent screen.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A color cathode-ray tube electron gun, which comprises:

a focusing electrode having at least a first focusing electrode, a second focusing electrode, a third focusing electrode and a fourth focusing electrode;

a quadruple lens action, formed by said third focusing electrode and said fourth focusing electrode;

a quadruple lens that controls said quadruple lens action, formed by said first focusing electrode, said second focusing electrode and said third focusing electrode; and openings in said first focusing electrode, said second focusing electrode and said third focusing electrode, corresponding to a right and a left electron beam emitted from said electron gun, said openings having different aspect ratios in adjacent focusing electrodes of said first focusing electrode, said second focusing electrode and said third focusing electrode, where each of said opening aspect ratios is set in such a manner that a major diameter/minor diameter is greater than 1.05.

2. A color cathode-ray tube electron gun as claimed in claim 1, wherein said openings corresponding to said right and left electron beams are set in said first focusing electrode, said second focusing electrode and said third focusing electrode in such a manner that a first series of openings defined on one end side of each of said first focusing electrode, said second focusing electrode, and said third focusing electrode are respectively set in a relationship of vertically-oblong, horizontally-oblong, vertically oblong, and a second series of openings defined on the other end side of each of said first focusing electrode, said second focusing electrode, and said third focusing electrode are respectively set in a relationship of horizontally-oblong, vertically-oblong, vertically-oblong.

3. A color cathode-ray tube electron gun as claimed in claim 1, wherein spaces between said first focusing electrode and said second focusing electrode, and between said second focusing electrode and said third focusing electrode, are selected in a range of from 0.3 to 0.7 mm.

4. A color cathode-ray tube electron gun as claimed in claim 1, wherein said openings have protruded portions of overhung shape formed thereon.

5. A color cathode-ray tube electron gun, which comprises:

a focusing electrode, having at least a first focusing electrode, a second focusing electrode, a third focusing electrode and a fourth focusing electrode, where a thickness of said second focusing electrode is less than a thickness of said first or third focusing electrode;

a quadruple lens action formed by said third focusing electrode and said fourth focusing electrode; and a quadruple lens that controls said quadruple lens action, formed by said first focusing electrode, said second focusing electrode and said third focusing electrode.

6. A color cathode-ray tube as claimed in claim 5, which further comprises:

openings in said first focusing electrode, said second focusing electrode and said third focusing electrode, corresponding to a right and a left electron beam emitted from said electron gun, wherein said openings are uniaxially disposed on said first focusing electrode, said second focusing electrode and said third focusing electrode, and are respectively set in a relationship of vertically-oblong, horizontally-oblong, vertically-oblong.

7. A color cathode-ray tube as claimed in claim 5, wherein said openings have protruded portions of overhung shape formed thereon.

* * * * *

UNITED STATES PATENT AND TRADEMARK OFFICE

CERTIFICATE OF CORRECTION

PATENT NO. : 6,172,450 B1
APPLICATION NO. : 09/135405
DATED : January 9, 2001
INVENTOR(S) : Makoto Natori et al.

It is certified that error appears in the above-identified patent and that said Letters Patent is hereby corrected as shown below:

On The Title Page,
Cover page, item [54], title, should read,

(54) ELECTRON GUN HAVING SPECIFIC FOCUSING STRUCTURE

Signed and Sealed this

Thirtieth Day of January, 2007

JON W. DUDAS
*Director of the United States Patent and Trademark Office*